US011842717B2

(12) United States Patent
He et al.

(10) Patent No.: US 11,842,717 B2
(45) Date of Patent: Dec. 12, 2023

(54) ROBUST OPEN-EAR AMBIENT SOUND CONTROL WITH LEAKAGE DETECTION

(71) Applicant: Maxim Integrated Products, Inc., San Jose, CA (US)

(72) Inventors: Jianjun He, San Jose, CA (US); Vivek Prakash Nigam, Dublin, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 0 days.

(21) Appl. No.: 17/371,066

(22) Filed: Jul. 8, 2021

(65) Prior Publication Data

US 2022/0076656 A1 Mar. 10, 2022

Related U.S. Application Data

(60) Provisional application No. 63/076,901, filed on Sep. 10, 2020.

(51) Int. Cl.
*G10K 11/178* (2006.01)
*H04R 1/10* (2006.01)

(52) U.S. Cl.
CPC ..... *G10K 11/17881* (2018.01); *H04R 1/1083* (2013.01); *G10K 2210/1081* (2013.01); *G10K 2210/3026* (2013.01); *G10K 2210/3028* (2013.01)

(58) Field of Classification Search
CPC ..... G10K 2210/1081; H04R 1/1083; H04R 2460/01
See application file for complete search history.

(56) References Cited

U.S. PATENT DOCUMENTS

| | | | | |
|---|---|---|---|---|
| 8,798,283 | B2 | 8/2014 | Gauger, Jr. et al. | |
| 9,142,205 | B2 | 9/2015 | Alderson et al. | |
| 9,467,769 | B2 | 10/2016 | Liu et al. | |
| 9,609,424 | B2 | 3/2017 | Goldstein | |
| 10,299,053 | B2 | 5/2019 | Usher et al. | |
| 2015/0071453 | A1* | 3/2015 | Po | G10K 11/17817 381/71.11 |
| 2016/0300562 | A1* | 10/2016 | Goldstein | G10K 11/17879 |
| 2017/0193974 | A1* | 7/2017 | Gadonniex | G10K 11/17881 |
| 2021/0304725 | A1* | 9/2021 | Kannan | G10K 11/17837 |

FOREIGN PATENT DOCUMENTS

| | | |
|---|---|---|
| CN | 108712703 B | 1/2019 |
| JP | 2004297304 | 9/2007 |

* cited by examiner

*Primary Examiner* — Ping Lee
(74) *Attorney, Agent, or Firm* — North Weber & Baugh LLP; Michael North

(57) ABSTRACT

Described herein are system and method embodiments for adaptive noise control for headphones, specifically for open-ear headphones. A leakage detection module in an ambient sound control (ASC) circuit implements leakage detection to determine a leakage mode. Based on the determined leakage mode, an ASC profile may create, select or modify an ASC profile for the ASC circuit to operate. Pilot tone, ambient noise, or audio playback may be used respectively or in combination for leakage detection. Experimental results show that embodiments of adaptive ASC approach may achieve improved performance compared to a default ASC, especially under loose fitting of an earphone.

17 Claims, 9 Drawing Sheets

100

900

ROBUST OPEN-EAR AMBIENT SOUND CONTROL WITH LEAKAGE DETECTION

CROSS-REFERENCE TO RELATED APPLICATION

This application claims the priority benefit under 35 USC § 119(e) to U.S. Provisional Patent Application No. 63/076,901, filed on Sep. 10, 2020, entitled "ROBUST OPEN-EAR AMBIENT SOUND CONTROL WITH LEAKAGE DETECTION" and listing Jianjun He and Vivek Nigam as inventors. The aforementioned patent document is incorporated by reference herein in its entirety.

A. TECHNICAL FIELD

The present disclosure relates generally to leakage detection and ambient sound control, and more specifically to leakage detection and ambient sound control for open-ear headphones.

B. BACKGROUND OF THE INVENTION

Noise-canceling headphones are widely in various situations where unwanted ambient sounds may be reduced using active noise cancellation (ANC).

Most ANC headphones have a closed-ear form-factor with an ear cup covering a user ear to form a sealed or closed cavity. An ANC headphone may use a microphone outside an ear cup (also called feedforward microphone), a feedback microphone inside an ear cup, or a combination using both feedforward and feedback microphones.

Although closed-ear ANC headphones may reduce or cancel unwanted ambient noise, they may become uncomfortable for longtime wearing. On the other hand, an open-ear earphone is relatively light weight, more convenient for long term wearing as it causes less discomfort and fatigue. However, open-ear earphone may face more challenges for ANC as there is a lack of a sealed cavity between ear buds and ear drums for ANC implementation. ANC may be more effective for sealed form factor like AirPods Pro where a silicone tip creates a sealed chamber between form factor and ear drums. While for open-ear earphones or for closed-ear headphone with loose fitting, the impact of ambient noise may vary constantly and the level of audio signal leakage may also change significantly. Furthermore, the response of the speaker in the earphone varies a lot depending on the fitting condition. Such issues make it challenging for effective ANC implementation.

Accordingly, it would be desirable to have systems and methods for robust leakage detection and adaptive ambient sound control for open-ear applications.

BRIEF DESCRIPTION OF THE DRAWINGS

Reference will be made to exemplary embodiments of the present invention that are illustrated in the accompanying figures. Those figures are intended to be illustrative, rather than limiting. Although the present invention is generally described in the context of those embodiments, it is not intended by so doing to limit the scope of the present invention to the particular features of the embodiments depicted and described.

FIG. ("FIG.") 1 depicts a schematic diagram of an open-ear earphone, according to one or more embodiments of the invention.

One skilled in the art will recognize that various implementations and embodiments of the invention may be practiced in accordance with the specification. All of these implementations and embodiments are intended to be included within the scope of the invention.

DETAILED DESCRIPTION OF THE PREFERRED EMBODIMENTS

In the following description, for purpose of explanation, specific details are set forth in order to provide an understanding of the present invention. The present invention may, however, be practiced without some or all of these details. The embodiments of the present invention described below may be incorporated into a number of different electrical components, circuits, devices, and systems. Structures and devices shown in block diagram are illustrative of exemplary embodiments of the present invention and are not to be used as a pretext by which to obscure broad teachings of the present invention. Connections between components within the figures are not intended to be limited to direct connections. Rather, connections between components may be modified, re-formatted, or otherwise changed by intermediary components.

When the specification makes reference to "one embodiment" or to "an embodiment" it is intended mean that a particular feature, structure, characteristic, or function described in connection with the embodiment being discussed is included in at least one contemplated embodiment of the present invention. Thus, the appearance of the phrase, "in one embodiment," in different places in the specification does not constitute a plurality of references to a single embodiment of the present invention.

Furthermore, connections between components or systems within the figures are not intended to be limited to direct connections. Rather, data or signal between these components may be modified, re-formatted, or otherwise changed by intermediary components. Also, additional or fewer connections may be used. It shall also be noted that the terms "coupled," "connected," or "communicatively coupled" shall be understood to include direct connections, indirect connections through one or more intermediary devices, and wireless connections.

One skilled in the art shall recognize that: (1) certain steps may optionally be performed; (2) steps may not be limited to the specific order set forth herein; (3) certain steps may be performed in different orders; and (4) certain steps may be done concurrently.

Figure 1:
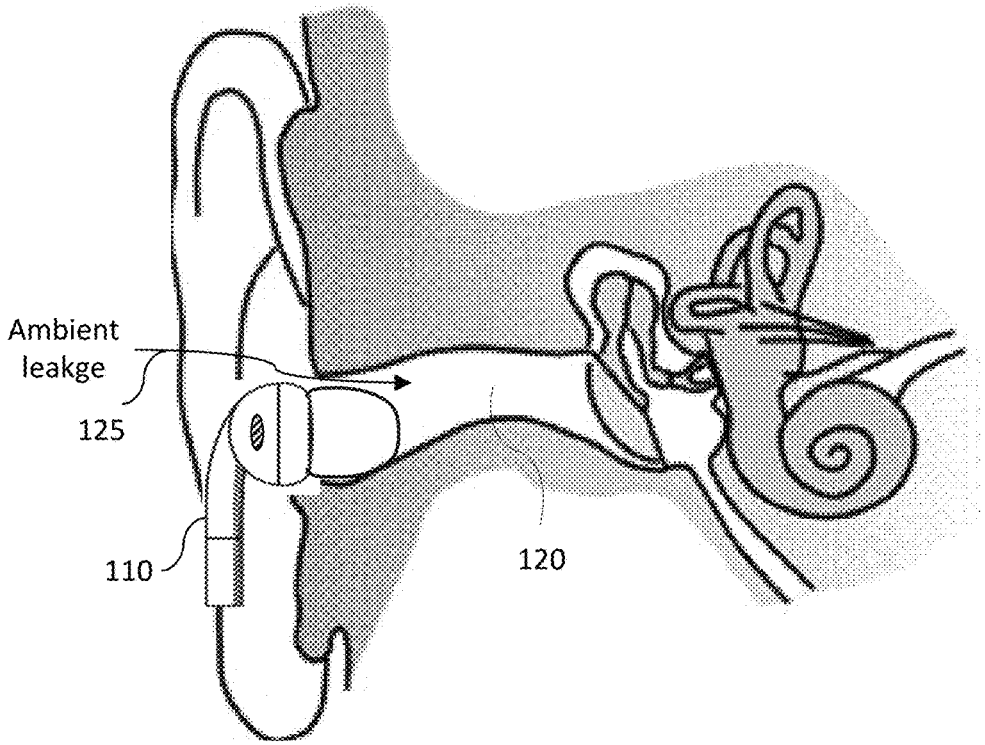

FIG. 1 is a schematic diagram of an open-ear earphone 110. Ambient noise may be leaked into the ear canal 120 from an ambient leakage path 125, indicated by a curved arrow in FIG. 1. This ambient leakage into the ear canal brings extra challenges in eliminating the ambient noise completely. Performance of the headphone speaker may become detrimentally affected by the leakage channels. For example, the response of the speaker to the audio playback delivered to the speaker—in particular, the user's perception of the sound produced by the speaker—may suffer. In some instances, the decrease in performance may affect different frequencies to a different degree. For example, the response of the speaker may be affected more at low frequencies and less at high frequencies. This may lead to a spectral distortion of the audio playback.

Although the leakage path 125 shown in FIG. 1 is a path between the earphone and an ear canal of an earphone user, the leakage path may be applicable to other paths that allow ambient sound leakage into the ear canal. For example, one open-ear earphone may have tight fitting to prevent an earphone from dropping when a user is in motion, but it may have one or more built-in vents to allow ambient sound leakage into the ear canal. One skilled in the art shall also understand that the diagram shown FIG. 1 may also be applicable to some closed-ear headphones. When a user improperly wears a close-ear headphone or when a close-ear headphone has defects in an ear cup, a leakage channel may appear to affect noise cancellation performance.

Because each user has unique ear anatomy, the geometry of the leakage channels, especially for open-ear earphones, is likely to change from user to user (and even from ear to ear, for a particular user). Furthermore, when a user is in motion or a noise of an ambient environment changes drastically, the implementation of noise cancellation may also need to be adjusted or updated. Accordingly, a one-size-fits-all ANC profile is likely to fail to deliver the top-quality noise-canceling performance.

One or more embodiments described in the present disclosure are related to adaptively output an ambient sound control (ASC) profile for an ASC circuit to operate according to a leakage mode, which is determined based on leakage detection. In one or more embodiments, the ASC circuit may function to lower ambient noise. In one or more embodiments, the ASC circuit may be a circuit for ANC. In one or more embodiments, the ASC circuit may be a circuit in a personal sound amplification product (PSAP) for hearing enhancement. Embodiments of the ASC may involve selective controlling level, frequency, spectrum of one or more sound sources in the ambient environment, where the controlling may operation of reducing, preserving, boosting or a combination thereof for desirable performance.

For ANC in earphone with open-ear configurations, an ASC circuit may need to be tuned with wider bandwidth (e.g., >700 Hz) due to poorer passive attenuation result from loose fit. Implementation profile of the ASC circuit may need to be updated constantly based on detected leakage level. Open-ear configurations result in non-sealed enclosures where single ASC profile may not be able to deliver consistent noise cancelling performance. Furthermore, different wearing styles may result in different amount of leakages of ambient noise and hence requires different ASC profiles to give consistent ASC performance. Hence the need for adaptive ASC with bank of ASC profiles. At least due to the constant leakage detection and profile update, power consumption of an open-ear earphone may increase, therefore, ASC implementation may need to be optimized.

In one or more embodiments, an ASC circuit may comprise one or more converters for analog-to-digital or digital-to-analog conversion, one or more filters (e.g., low-pass filters, high pass filters, band-pass filters, and/or band-stop filters) and/or one or more gain/volume stages operating at various frequency bands. Each of the filters or gain/volume stages may have its operation parameters, e.g., cut-off frequency, gain, bandwidth, etc. In one or more embodiments, an ASC profile may be referred as a set of operational parameter levels, limits, or ranges for components (e.g., filters, gain/volume stages, etc.) in the ASC circuit.

In one or more embodiments, it may be desirable for the ASC circuit to have different profiles in response to different ambient environments. For example, in a quiet environment, it might be preferable to have the ASC circuit operating in a "mild" profile with low amplification or small parameter ranges such that the ASC circuit only needs to search in a narrow parameter ranges for noise compensation and thus lower power consumption may be achieved. While in a noisy environment with a loud low-frequency noise, it might be desirable to have the ASC circuit operating in a more aggressive profile with larger parameter ranges for low-frequency filters or gain/volume stages but maintain a relatively low parameter range for high-frequency filters or gain/volume stages, such that the ASC circuit searches in wide parameter ranges for low-frequency noise compensation but maintains a low operation parameter ranges for high-frequency noise compensation. Such an adaptive ASC profile setup may not only enable fast dynamic response for noise compensation, but also achieve noise compensation with lower power consumption.

Figure 2:
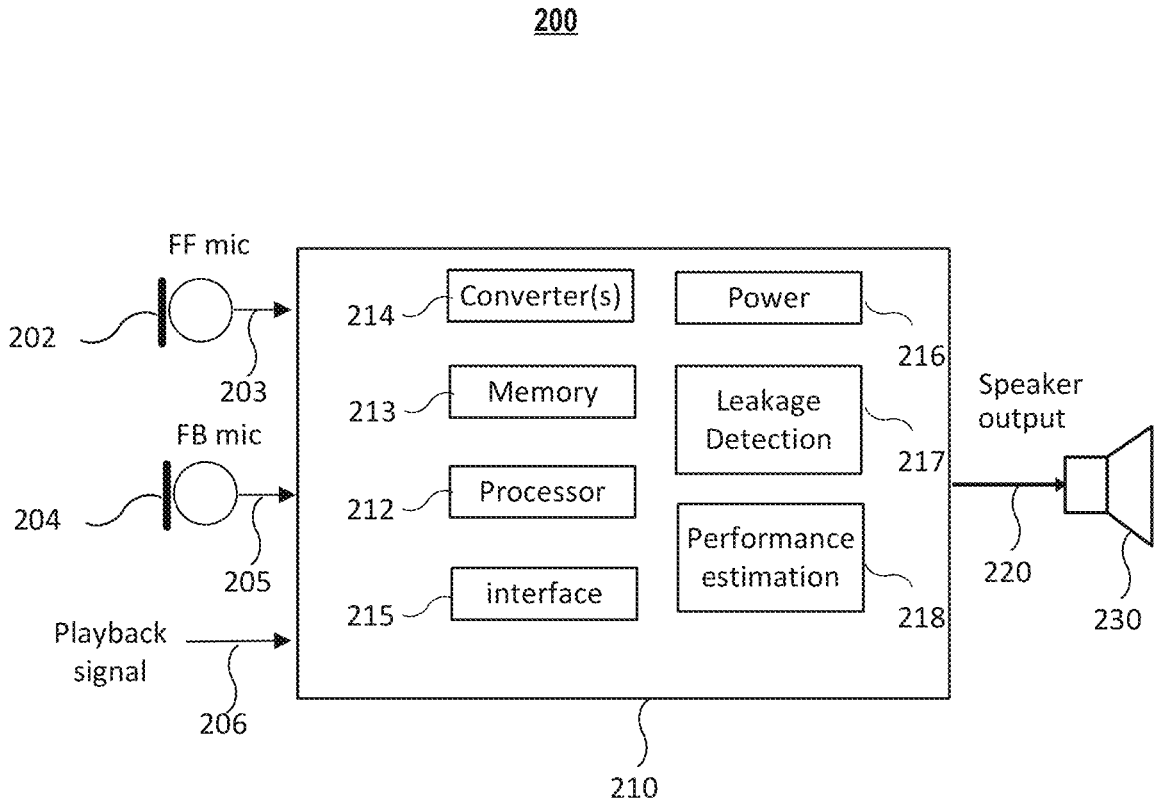
FIG. 2 depicts a block diagram for an adaptive ambient sound control (ASC) circuit according to one or more embodiments of the invention.

FIG. 2 is a block diagram for an ambient sound control circuit according to one or more embodiments of the invention. The ASC circuit 210 couples to a first microphone 202, a second microphone 204, and a speaker 230. In one more embodiments, the first microphone 202 is a feedforward microphone (hereinafter "FFM" or "FF mic") placed on the outside of the earphone 110, the second microphone 204 is a feedback microphone (hereinafter "FBM" or "FB mic") placed inside of the earphone 110 and in proximity of the speaker 230. The ASC circuit 210 receives a microphone signal 203 from the FF mic 202, a microphone signal 205 from the FB mic 204, and the playback signal 206, and generates an output signal 220, which counteracts ambient noise, for the speaker 230 to play.

In one or more embodiments, the ASC circuit 210 may include one or more processors 212, and one or more memory devices 213, one or more converters 214 for analog-to-digital or digital-to-analog conversion, an interface 215 for data communication, and a power source 216. The processors 212 may be a Field Programmable Gate Array (FPGA), an application-specific integrated circuit (ASIC), a digital signal processor (DSP), a media control unit (MCU), a System-on-Chip processor (SoC), or may be some other types of a processor. The memory devices 213 may include a random-access memory (RAM), a read-only-memory (ROM), a storage device, or any medium capable of storing electronic instructions or information in a form readable by a processor. In one or more embodiments, the ASC circuit 210 may comprise a leakage detection module 217 to implement leakage detection. In one or more embodiments, the ASC circuit 210 may further comprise a performance estimation module 218 to implement playback and/or ASC performance estimation. Results from leakage detection and/or performance estimation may be used as a reference for ASC circuit operation profile determination. The leakage detection module 217 and performance estimation module 218 may be a software/firmware component executed by the processor(s) 212 using the instructions stored in the memory 213. In some implementations, the leakage detection module 217 may be activated when a headphone is in either an ASC mode (e.g., ANC mode without any audio playback) or in a playback mode or both ASC and playback are active.

In one or more embodiments, the one or more converters 214 may comprise analog-to-digital converters to convert the microphone signal 203 from the FF mic 202 and the microphone signal 205 from the FB mic 204 into digital signals for processing.

In one or more embodiments, the ASC circuit 210 may comprise one or more filters (e.g., low-pass filters, high pass filters, band-pass filters, and/or band-stop filters) to implement one or more filtering operations. The one or more filters may be digital filters using instructions executable on one or more processors 214 to perform desired mathematical operations on digital signals. Filter parameters, e.g., filter coefficients, may be stored in the memory 213.

In one or more embodiments, the playback signal 206 is an analog signal and the interface 215 may be a wired interface to receive the playback signal 206 and other control signals, e.g., volume up/down, etc. In one or more embodiments, the interface 215 may be a wireless interface, e.g., a Bluetooth interface, to receive the playback signal 206 and other control signals wirelessly.

In one or more embodiments, the ASC circuit 210 may be integrated together with the FF mic 202, the FB mic 204, and the speaker 230 into an earphone (or earbud, earpiece, or in-ear headphones, etc.). In one or more embodiments, the ASC circuit 210 may be a separate component coupled to the FF mic 202, the FB mic 204, and the speaker 230 in an earphone in wire connection or wirelessly.

As used herein, the term "earphone" is referring as a device that delivers an audio content through a compact environment that encloses at least a part of the user's ear, such as the ear canal or the outer ear (as opposed to delivering the audio content through the ambient air, as in the case of a loudspeaker, such as a speaker of a home sound system or a smart phone built-in speaker). Accordingly, an earphone may be in a form of over-the-ear headphones, earbuds, or in-ear headphones, etc. As used herein, the plural term "earphones" means both a device intended to be used with a single ear as well as with two ears. As used herein, the term "audio" means sound within a hearing range of a user. As used herein, the term "sound" means any wave of air pressure, within or outside the hearing range of a user. For example, a wave of frequency 100 Hz may be referred in the instant disclosure to as either a sound or an audio, whereas a wave of frequency 15 Hz (i.e. below the human hearing range, typically 20 Hz to 20 kHz) may be referred to as a sound.

Figure 3:
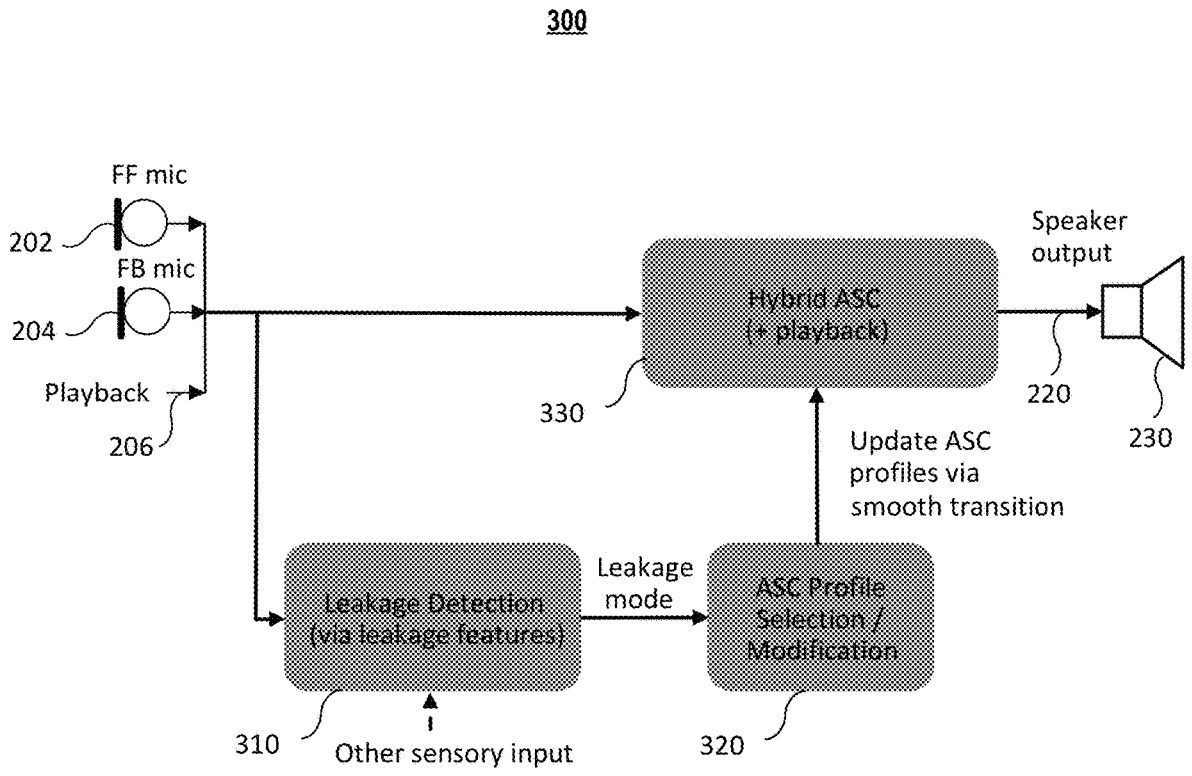
FIG. 3 graphically depicts a process for adaptive ASC based on leakage detection according to one or more embodiments of the invention.

FIG. 3 graphically depicts a process for adaptive ASC based on leakage detection according to one or more embodiments of the invention. In step 310, a leakage detection module implements leakage detection to generate a leakage mode signal based on one or more inputs from the FF mic 202, the FB mic 204 or playback signal 206. The leakage mode signal may indicate a level of leakage, and/or ambient noise intensity and spectrum distribution inside an ear cannel. Various approaches may be used for leakage detection. Some detailed embodiments, such as using pilot tone in audio playback, ambient noise analysis, and playback audio analysis, are described hereinafter in connection to FIGS. 5-8. In step 320, an ASC profile selection and modification module output an ASC profile based on the leakage mode signal. The ASC profile may be selected among a plurality of ASC profiles, newly created using the leakage mode signal, modified from an existing ASC profile. In one or more embodiments, the ASC profile selection and modification module may be a software module comprising instructions stored in the memory of the ASC circuit. In one or more embodiments, the ASC profile selection and modification module may be external to the ASC circuit and communicatively coupled to receive the leakage mode signal for ASC profile selection, creation or modification. For example, the ASC profile selection and modification module may be within an electronic device (e.g., a music player, a smartphone, etc.) which generates the audio playback signal. In one or more embodiments, the ASC profile selection and modification module may comprise a database correlating various leakage modes to various ASC profiles. In one or more embodiments, one correlation may be 1:1, N:1 or 1:N relations (N being an integer number larger than 1) between leakage modes and ASC profiles. The correlations may be predefined and may or may not be able to be modified. The ASC profile selection and modification module may compare the leakage mode signal received from the leakage detection module against leakage modes in the database. If a match is identified, a corresponding ASC profile is selected as the ASC profile output. If no match is identified, a new ASC profile may be newly created as the ASC profile output. Alternatively, an existing ASC profile with the closed match may be modified as the ASC profile output.

In step 330, the ASC circuit applies the ASC profile output to generate a speaker output 220 for the speaker 230 to play. Depending on operation mode (e.g., quiet mode or playback mode) of the earphone, the speaker output may or may not comprise the playback audio signal. In one or more embodiments, steps 310-330 may be repeated in a pre-determined time interval.

Figure 4:
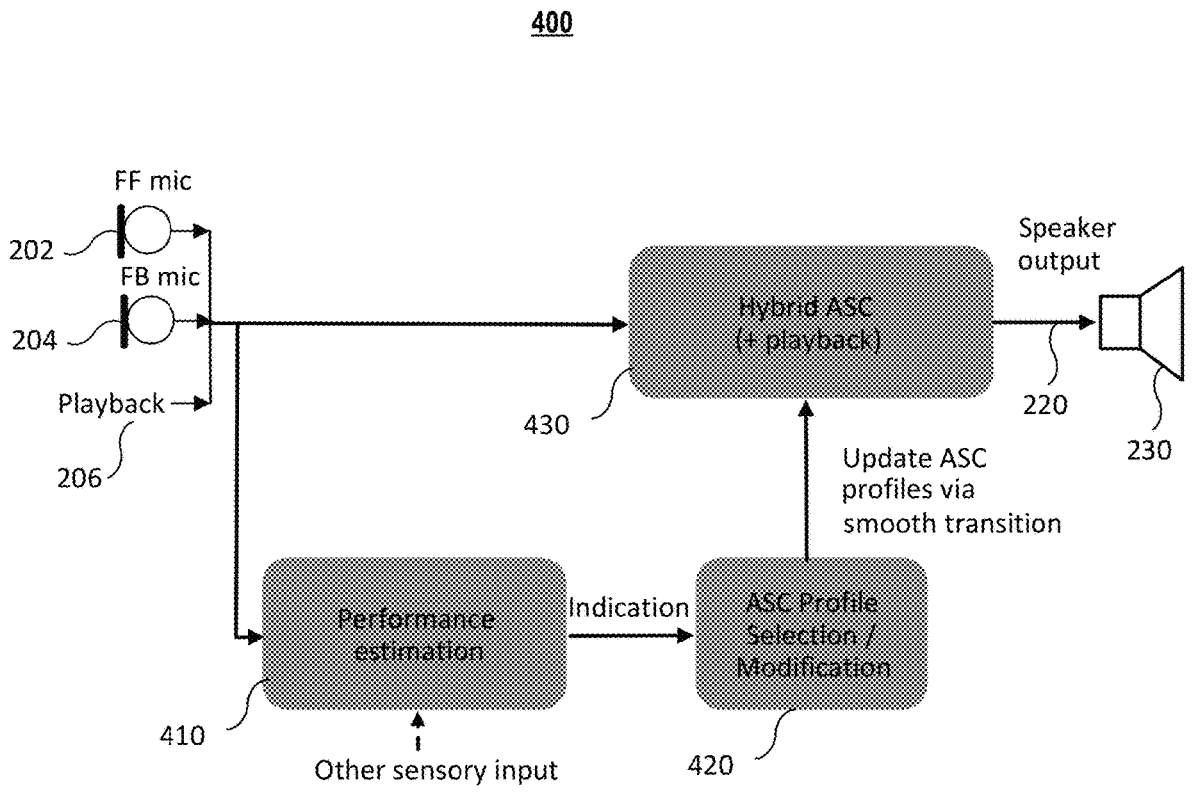
FIG. 4 graphically depicts a process for adaptive ASC based on performance estimation according to one or more embodiments of the invention.

FIG. 4 graphically depicts a process for adaptive ASC based on performance estimation according to one or more embodiments of the invention. Instead of driven by leakage detection, the performance estimation based ASC may be driven by audio playback and/or ASC performance optimization. With the implementation of adaptive ASC based on performance estimation, it may be desired to have overall minimum distortion or minimized distortion for certain frequency bands for the playback audio instead of having minimum ambient noise. For leakage detection based adaptive ASC, sound from the speaker may be distorted from the original audio playback when the ASC circuit adds a compensation signal to the audio playback signal in order to minimize ambient noise. As a result, user audio experience may be impacted negatively.

In step 410, a performance estimation module implements performance estimation to generate an indication signal based on one or more inputs from the FF mic 202, the FB mic 204 or playback signal 206. The indication signal may indicate a level of audio playback and/or ASC performance. In one or more embodiments, the indication signal may indicate a level of playback distortion under current ambient noise, and/or distortion spectrum distribution. In one or more embodiments, the performance estimation may comprise a comparison between the playback signal 206 and input from the FB mic 204. In one or more embodiments, the indication signal may indicate a level of ambient noise and/or noise spectrum distribution to indicate the performance of the ASC circuit.

In step 420, an ASC profile selection and modification module output an ASC profile based on the indication signal. Similar to step 320, the ASC profile may be selected among a plurality of ASC profiles from a database correlating various indication levels to various ASC profiles, newly created using the leakage mode signal, modified from an existing ASC profile. The correlations may be predefined and may or may not be able to be modified. The ASC profile selection and modification module may compare the indication signal received from the performance estimation module against indication signals in the database. If a match is identified, a corresponding ASC profile is selected as the ASC profile output. If no match is identified, a new ASC profile may be newly created as the ASC profile output. Alternatively, an existing ASC profile with the closed match may be modified as the ASC profile output.

In step 430, the ASC circuit applies the ASC profile output to generate a speaker output 220 for the speaker 230 to play. In one or more embodiments, steps 410-430 may be repeated in a pre-determined time interval.

Figure 5:
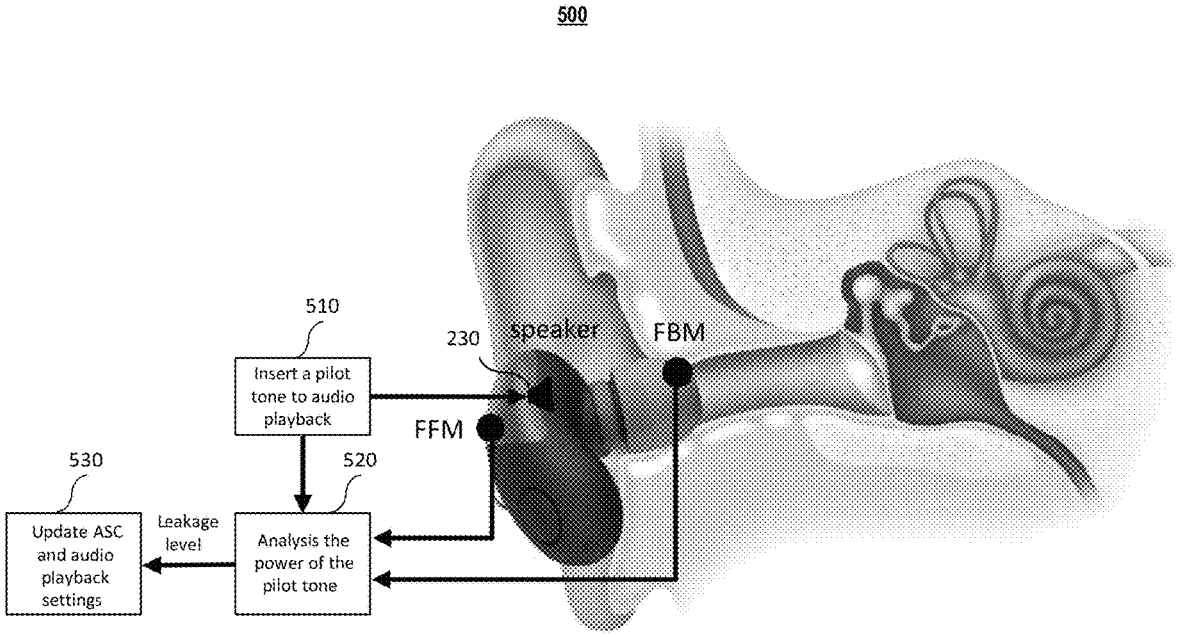
FIG. 5 depicts a schematic diagram of using a pilot tone for leakage detection and ASC update according to one or more embodiments of the invention.

FIG. 5 depicts a schematic diagram of using a pilot tone for leakage detection and ASC update according to one or more embodiments of the invention. In some implementations, the frequency of the pilot tone may be at a value (e.g. below 20 Hz) below the hearing range. Such a setting may have the benefit of not disturbing the user of the headphones. Although it is still technically possible to use the pilot tone of a frequency within the hearing range, such an approach may be disfavored by the user since it may cause playback audio interference. In some implementations, the pilot tone may contain several discrete or quasi-discrete frequencies. In some implementations, the pilot tone may be a narrowband signal or include two or more narrowband signals. In one or more embodiments, the use of pilot tone may be implemented with or without presence of audio playback signal. For example, a user may just want noise cancelation for a quiet time rather than some audio playback. In such instances, in order not to disturb the silence desired by the user, a pilot tone may be used not involving audio playback (e.g., the earphones are used only in the noise-canceling mode). Alternatively, the ASC circuit may insert (510) a pilot tone with a frequency below the lower threshold of the human hearing range into an audio playback.

Following the insertion of the pilot tone into audio playback for playing by the speaker 230, response signals of the FBM and/or the FFM to the pilot tone are analyzed (520) to determine a leakage level. In one or more embodiments, the analysis may comprise a power analysis for the responses corresponding to the frequency of the pilot tone. Afterwards, an ASC profile and audio playback settings may be updated (530) based on the determined leakage level.

Figure 6:
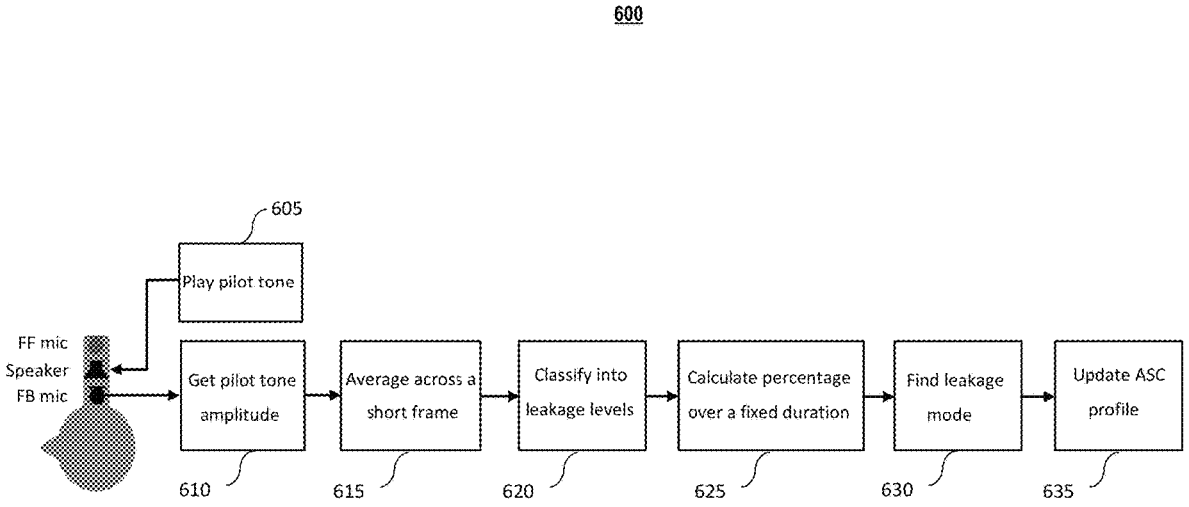
FIG. 6 graphically depicts a process of using a pilot tone for leakage detection and ASC update according to one or more embodiments of the invention.

FIG. 6 graphically depicts a process of using a pilot tone for leakage detection and ASC update according to one or more embodiments of the invention. In step 605, a pilot tone with pre-determined amplitude e.g., −40 dB, is played at the speaker of an earphone. The pilot tone has a frequency, e.g., below 20 Hz, below the hearing range such that a user may not even notice the pilot tone. In one or more embodiments, the pilot tone is added into an audio playback or a standalone pilot tone to be played by the speaker. In response to the played pilot tone, the FB mic output a FB mic signal. In step 610, amplitude of the FB mic signal at the frequency of the pilot tone is obtained. In step 615, the amplitude is averaged across every short frame, e.g., 0-1 s, to obtain a plurality of average amplitudes. In step 620, the plurality of average amplitudes are classified into various leakage levels based on predetermined classifications. In one or more embodiments, the predetermined classifications are stored in the memory of the ASC circuit as calibration reference to determine leakage levels and/or the needed modification of the ASC/playback signal for a specific fit being probed with the pilot tone.

In step 625, over a predetermined time interval, e.g., an interval between 1 s and 1 min, the leakage level with the highest classification percentage is calculated and compared to one or more thresholds. In step 630, a leakage mode is identified based on the comparisons. In step 635, an ASC profile is determined or updated based on the identified leakage mode.

It shall be noted that the steps shown in FIG. 6 for pilot signal based leakage detection are exemplary and performed under specific parameters and/or conditions using a specific embodiment or embodiments; accordingly, neither these settings and/or processes shall be used to limit the scope of the disclosure of the current patent document.

Figure 7:
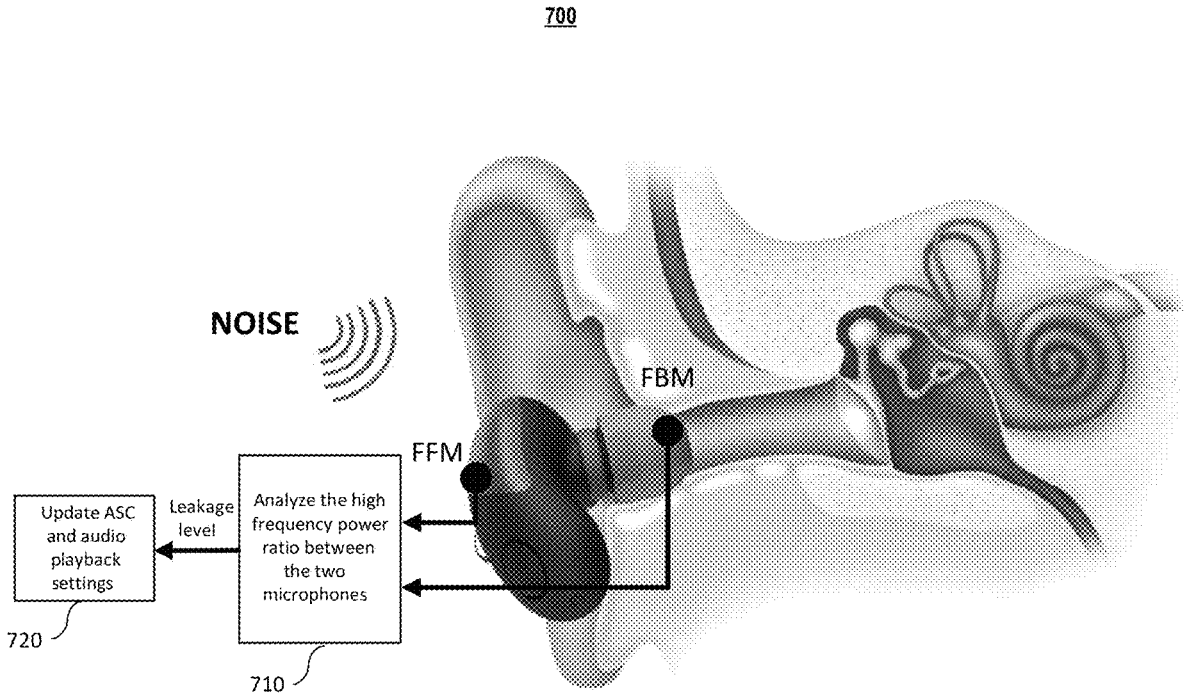
FIG. 7 depicts is a schematic diagram of using ambient noise for leakage detection and ASC update according to one or more embodiments of the invention.

FIG. 7 depicts is a schematic diagram of using ambient noise for leakage detection and ASC update according to one or more embodiments of the invention. As shown in FIG. 7, the leakage detection module may perform leakage detection and compensation by detecting an ambient noise through the FFM and the FBM. The noise detected by the FFM located near the outer surface of the earphone may represent the intensity of the ambient noise in the immediate user's surroundings. The ambient noise may make its way into the user's ear canal, including through a leakage channel. In one or more embodiments, the leakage detection shown in FIG. 5 may be implemented during regular audio playback. In such an implementation, the leakage detection module may need to separate the audio playback from ambient noise in the total audio signal detected by the FBM and/or the FFM. In one or more embodiments, in order to not skew the detection of the ambient noise, the speaker in the earphone may be muted during the time leakage detection using ambient noise is being implemented. Once the ambient noise has been isolated in the total audio signal or recorded, the leakage detection module may analyze (710) a power ratio over certain frequency range, e.g., a power ratio on high audio frequency band, between the ambient noise detected by the FBM inside the ear canal and the ambient noise detected by the FFM to determine a leakage level or leakage mode. In one or more embodiments, because the source of the ambient noise is located outside the earphone, the ratios $R_i$ (for multiple frequencies $f_i$) of the ambient noise intensities (or amplitudes) of the ambient noise detected by the FFM to those detected by the FBM may be greater than 1, and in some situations may be much greater than 1. During the analysis of the intensities, the leakage detection module may take into account that some amount of the ambient noise would make to the ear canal—through the skin, cartilages, and bones of the user—other than through a leakage channel. The leakage detection module may, therefore, discount some of the data provided by the FBM and account only for the fraction of the noise in the ear canal that may be attributed to the leakage channels. The discount may be performed by reducing the intensities (or amplitudes) of the ambient noise, as detected by the FBM, by discount factors. The discount factors may be determined at (or before) the time of the manufacturing of the headphones and stored in the memory in the ASC circuit. Based on the determined leakage level, an ASC profile and audio playback settings may be updated (720). In one or more embodiments, the ambient noise detection may be combined with the pilot sound detection shown in FIG. 5 for added overall reliability of the leakage detection and compensation.

Figure 8:
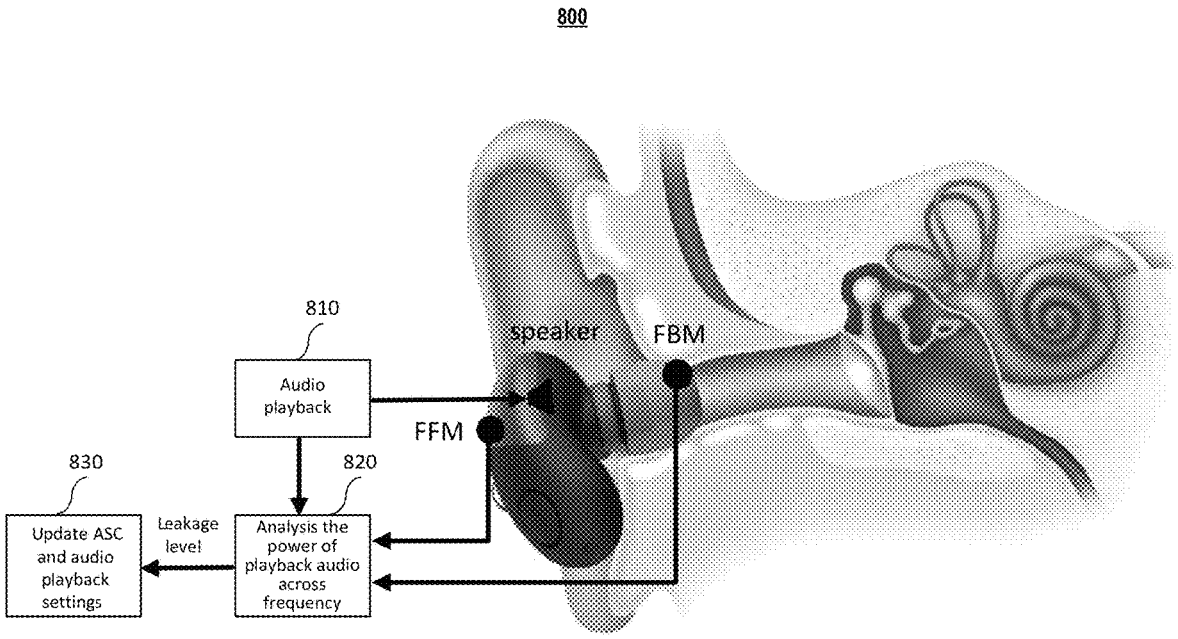
FIG. 8 depicts is a schematic diagram of using audio playback for leakage detection and ASC update according to one or more embodiments of the invention.

FIG. 8 depicts is a schematic diagram of using audio playback for leakage detection and ASC update according to one or more embodiments of the invention. When a user is operating the earphones for audio playback, audio playback sound is output (810) from the earphone speaker and picked up by the FBM and the FFM. The ASC circuit may analyze (820) microphone signals from the FBM and the FFM to determine a leakage level or leakage mode. Based on the determined leakage level or mode, an ASC profile and audio playback settings may be updated (830). In one or more embodiments, the audio playback based leakage detection approach may be combined with the pilot sound based leakage detection approach shown in FIG. 5 and/or ambient noise based leakage detection shown in FIG. 7 for added overall reliability of the leakage detection and compensation. Since the audio playback typically has a broad range of audio frequencies, the audio playback based leakage detection approach may have an advantage over pilot sound based leakage detection approach, where the pilot sound may be confined to the infrasound frequencies and therefore may not accurately reflect leakage situation in audio frequency range (e.g. 20 Hz to 20 kHz). The presence of the audio frequencies in the audio playback may improve the accuracy of the leakage detection. In one or more embodiments, leakage analysis may be performed for multiple frequencies to determine the leakage ratios for multiple frequencies. On the other hand, an audio playback may have a substantial variance in its spectral content, augmenting the audio playback based leakage detection with the pilot tone based leakage detection may improve the overall reliability of the leakage detection and compensation.

Described hereinafter are some experimental comparison results. It shall be noted that these experiments and results are provided by way of illustration and were performed under specific conditions using a specific embodiment or embodiments; accordingly, neither these experiments nor their results shall be used to limit the scope of the disclosure of the current patent document.

Figure 9:
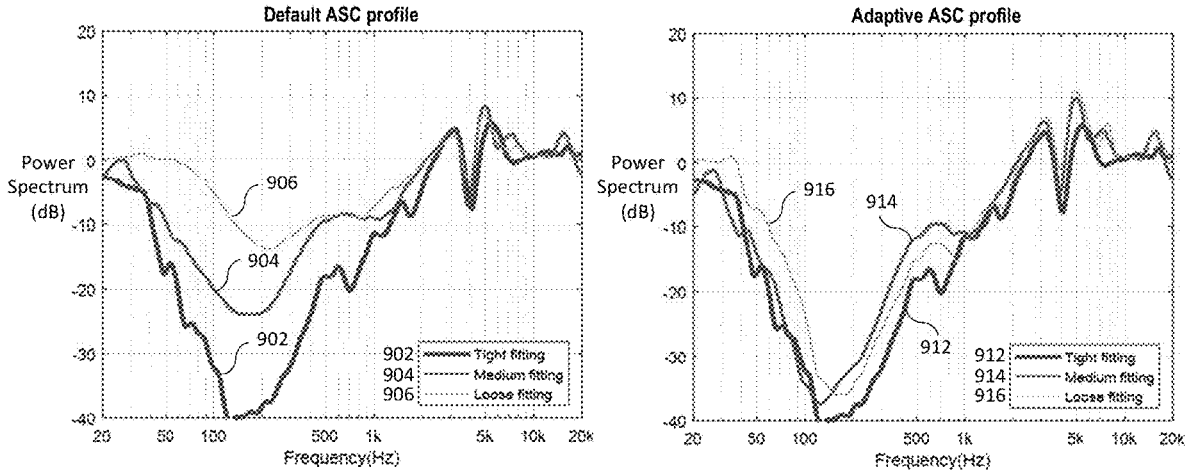
FIG. 9 depicts an ANC performance comparison between a default ASC and an adaptive ASC embodiment under various fittings according to one or more embodiments of the invention.

FIG. 9 depicts an ANC performance comparison between a default ASC and an adaptive ASC embodiment under tight fitting, medium fitting, and loose fitting according to one or more embodiments of the invention. Lines 902, 904, and 906 are referred to power spectrum in dB of audio signal measured at a feedback microphone of a headphone with a default ASC for tight fitting, medium fitting, and loose fitting respectively. Lines 912, 914, and 914 are referred to power spectrum in dB of audio signal measured at the feedback microphone of the same headphone using an adaptive ASC for tight fitting, medium fitting, and loose fitting respectively. It may be seen that the default ASC works well for tight fitting only. It may also be seen clearly from FIG. 9 that under medium or loose earphone fitting, the adaptive ASC has improved performance compared to the default ASC. It shall be understood that though audio signal measured at the feedback microphone of a headphone is used for the experiment in FIG. 9, other types of microphones insider the ear may also be used to captures sound pressure level (SPL) in-ear for evaluation and testing.

The foregoing description of the invention has been described for purposes of clarity and understanding. It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

What is claimed is:

1. A method for adaptive noise control in an earphone, the method comprising:

implementing, using a leakage detection module, leakage detection to determine a leakage mode for the earphone, the leakage detection involves at least one of a feedforward microphone positioned outside of the earphone and a feedback microphone placed inside of the earphone, the feedforward microphone and the feedback microphone are integrated together with a speaker within the earphone, the leakage detection is related to ambient sound leakage through at least an ambient leakage path disposed between a portion of an ear canal and a portion of the earphone, wherein implementing leakage detection comprises inserting a pilot tone with a pre-determined frequency for the speaker to play, and analyzing microphone signal from the feedback microphone to determine the leakage mode;

outputting, using an ambient sound control (ASC) profile selection and modification module, a set of operational parameter ranges for components in an ASC circuit based on the determined leakage mode, the ASC circuit has different sets of operational parameter ranges corresponding to different leakage modes; and generating, using the ASC circuit operated within the set of operational parameter ranges, a speaker output for the speaker to play.

2. The method of claim 1, wherein the ambient leakage path is formed due to an open-ear form factor or a loose fitting for the earphone.

3. The method of claim 1, wherein the ASC circuit is a circuit for active noise cancellation.

4. The method of claim 1, wherein the set of operational parameter ranges is defined as an ASC profile selected among a plurality of ASC profiles from a database correlating various leakage modes to various ASC profiles based on the determined leakage mode.

5. The method of claim 1, wherein the set of operational parameter ranges is defined as an ASC profile newly created based on the determined leakage mode.

6. The method of claim 1, wherein the set of operational parameter ranges is defined as an ASC profile modified from an existing ASC profile.

7. The method of claim 1, wherein implementing leakage detection comprising:

analyzing a power ratio between ambient noise detected by the feedback microphone and ambient noise detected by the feedforward microphone to generate the leakage mode.

8. The method of claim 1, wherein implementing leakage detection comprising:

playing, using the speaker, an audio playback; and analyzing microphone signals from the feedback microphone and the feedforward microphone to determine the leakage mode.

9. An earphone comprising:

a speaker;

a feedforward microphone positioned outside of the earphone and a feedback microphone placed inside of the earphone, the feedforward microphone and the feedback microphone are integrated together with the speaker within the earphone;

a leakage detection module that implements leakage detection to determine a leakage mode for the earphone, the leakage detection involves at least one of the feedforward microphone and the feedback microphone, the leakage detection is related to ambient sound leakage through at least an ambient leakage path disposed between a portion of an ear canal and a portion of the earphone, wherein implementing leakage detection comprises inserting a pilot tone with a pre-determined frequency for the speaker to play, and analyzing microphone signal from the feedback microphone to determine the leakage mode;

an ambient sound control (ASC) profile selection and modification module that outputs a set of operational parameter ranges for components in an ASC circuit based on the determined leakage mode, the ASC circuit has different sets of operational parameter ranges corresponding to different leakage modes; and the ASC circuit that operates within the set of operational parameter ranges to generate a speaker output for the speaker to play.

10. The earphone of claim 9, wherein the ASC circuit is a circuit for active noise cancellation.

11. The earphone of claim 9, wherein the set of operational parameter ranges is defined as an ASC profile selected among a plurality of ASC profiles from a database correlating various leakage modes to various ASC profiles based on the determined leakage mode.

12. The earphone of claim 9, wherein the set of operational parameter ranges is defined as an ASC profile newly created based on the determined leakage mode.

13. The earphone of claim 9, wherein the set of operational parameter ranges is defined as an ASC profile modified from an existing ASC profile.

14. A non-transitory computer-readable medium or media comprising one or more sequences of instructions which, when executed by at least one processor, causes steps for adaptive noise control for an earphone integrated with a feedforward microphone positioned outside of the earphone, a feedback microphone placed inside of the earphone, and a speaker to be performed, the steps comprising:

implementing, using a leakage detection module, leakage detection to determine a leakage mode for the earphone, the leakage detection involves at least one of the feedforward microphone and the feedback microphone, the leakage detection is related to ambient sound leakage through at least an ambient leakage path disposed between a portion of an ear canal and a portion of the earphone, wherein implementing leakage detection comprises inserting a pilot tone with a pre-determined frequency for the speaker to play, and analyzing microphone signal from the feedback microphone to determine the leakage mode; and outputting, using an ambient sound control (ASC) profile selection and modification module, a set of operational parameter ranges for components in an ASC circuit within the earphone based on the determined leakage mode for the ASC circuit to be operated within the set of operational parameter ranges, the ASC circuit has different sets of operational parameter ranges corresponding to different leakage modes.

15. The non-transitory computer-readable medium or media of claim 14 wherein the set of operational parameter ranges is defined as an ASC profile selected among a plurality of ASC profiles from a database correlating various leakage modes to various ASC profiles based on the determined leakage mode.

16. The non-transitory computer-readable medium or media of claim 14, wherein the set of operational parameter ranges is defined as an ASC profile newly created based on the determined leakage mode.

17. The non-transitory computer-readable medium or media of claim 14, wherein the set of operational parameter ranges is defined as an ASC profile modified from an existing ASC profile.

* * * * *